US007343744B2

(12) United States Patent
Abelson et al.

(10) Patent No.: US 7,343,744 B2
(45) Date of Patent: Mar. 18, 2008

(54) METHOD AND SYSTEM FOR CONTROLLING A REHEAT TURBINE-GENERATOR

(75) Inventors: Sheldon S. Abelson, Niskayuna, NY (US); Michael Glynn Wise, Roanoke, VA (US); Michael James Molitor, Guilderland, NY (US)

(73) Assignee: General Electric Company, Schenectady, NY (US)

( * ) Notice: Subject to any disclaimer, the term of this patent is extended or adjusted under 35 U.S.C. 154(b) by 257 days.

(21) Appl. No.: 11/161,223

(22) Filed: Jul. 27, 2005

(65) Prior Publication Data

US 2007/0022756 A1 Feb. 1, 2007

(51) Int. Cl.
*F01K 13/02* (2006.01)

(52) U.S. Cl. ..... 60/646; 60/657; 60/660

(58) Field of Classification Search ..... 60/646, 60/657, 660

See application file for complete search history.

(56) References Cited

U.S. PATENT DOCUMENTS

| | | | | |
|---|---|---|---|---|
| 3,601,617 A | | 8/1971 | De Mello et al. | 290/40 C |
| 3,848,138 A | * | 11/1974 | Park | 290/40 R |
| 3,913,329 A | | 10/1975 | Priluck | 60/660 |
| 5,042,247 A | * | 8/1991 | Moore | 60/773 |
| 5,199,256 A | * | 4/1993 | Moore | 60/39.182 |
| 5,301,499 A | | 4/1994 | Kure-Jensen et al. | 60/39.03 |

* cited by examiner

*Primary Examiner*—Hoang Nguyen
(74) *Attorney, Agent, or Firm*—Cantor Colburn LLP

(57) ABSTRACT

A method for controlling a turbine-generator including: detecting a power-load unbalance between a turbine and a generator; measuring the duration of a power-load unbalance; measuring the rate of loss of an electrical load; and regulating steam flow through the turbine responsive to the rate of loss of an electrical load and the duration of the power-load unbalance; all of which results in more accurate and robust control of turbine-generator speed.

13 Claims, 5 Drawing Sheets

METHOD AND SYSTEM FOR CONTROLLING A REHEAT TURBINE-GENERATOR

BACKGROUND

This disclosure relates generally to control systems for turbines, and more specifically to measuring generator operating parameters to detect a loss of load that results in a large unbalance between power and load that would result in turbine-generator overspeed trip and provide turbine overspeed protection that will avoid a turbine trip due to the emergency overspeed trip device.

In a typical reheat turbine speed-load control system, valves regulate steam flow to both the high-pressure and reheat stages of the turbine in order to maintain the turbine speed at a predetermined reference speed. A main control valve regulates steam flow into the high-pressure stages and an intercept control valve regulates steam flow into the reheat stages. On the occurrence of an overspeed condition while the generator is separated from the system, the main control valve and intercept control valve are totally or partially closed to decrease steam flow into their respective stages to effect a reduction of turbine speed to the reference speed.

These reheat turbine speed-load control systems operate effectively to prevent an emergency overspeed trip on the occurrence of sudden total load loss where the load lost is small compared to the total generating capacity of the turbine-generator set. In this case a rapid complete closure of the intercept control valve causes the loss of a major portion of the driving power normally provided by the reheat stages and similarly steam flow to the high-pressure stages is reduced by closure of the main control valve. The control basis for these valve closures is the difference between the actual speed and the reference speed.

On the occurrence of sudden severe total loss of load where the load lost is comparable to a significant portion of the generating capacity of the turbine generator set, the turbine speed-load control systems, as described above, can not prevent an emergency overspeed trip. Delaying rapid complete closure of the intercept valve and control valve until the actual speed increases above the reference speed in order to avoid an emergency overspeed trip is not effective due to the larger control and intercept valve opening and the larger power density at high load conditions. Initiation of control valve and intercept valve closure must be advanced in time sufficiently to begin cut-off of steam prior to actual speed increase. Total electrical load loss is characteristically a rapid event when compared to rate of change for turbine power production. This situation can be used to provide detection of the conditions leading to turbine generator overspeed as described in this disclosure and prior art. When the characteristic conditions of load loss and unbalance between power and load are detected as described in this disclosure, rapid closure of turbine steam control valve and intercept valve is initiated, removing a major portion of the driving power to avoid an emergency overspeed trip. Hence, once the steam supply to the turbine is cut-off, the speed will increase due to the entrained steam mass as it proceeds to exhaust, but the speed increase will not be as rapid and will peak at a lower value thus avoiding an emergency overspeed trip. After the entrained steam is exhausted, speed will decrease and the turbine intercept valve and control valve will open based on speed-load control.

BRIEF DESCRIPTION

Disclosed herein is a method for controlling a turbine-generator including: detecting an unbalance between turbine mechanical power and generator electrical load; measuring a duration of the power-load unbalance; measuring a rate of loss for an electrical load; and regulating steam flow through said turbine responsive to the rate of loss for an electrical load and the duration of said power-load unbalance.

Further disclosed herein is a turbine-generator control system including: a power-load unbalance module; a turbine speed-load control module; and one or more close override devices wherein the power-load unbalance module detects a power-load unbalance between a turbine and a generator and identifies a cause of the power-load unbalance.

Yet further disclosed herein is a system for anticipating and limiting overspeed of a turbine including: means for improved detection of a power-load unbalance; means for determining the duration of the power-load unbalance; means for calculating a current rate of change; and means for regulating steam flow through the turbine being responsive to at least one of the means for detecting a power-load unbalance, the means for determining the duration of the power-load unbalance, and the means for calculating a current rate of change.

Other systems, methods, and/or computer program products according to exemplary embodiments will be or become apparent to one with skill in the art upon review of the following drawings and detailed description. It is intended that all such additional systems, methods, and/or computer program products be included within this description, be within the scope of the present invention, and be protected by the accompanying claims.

BRIEF DESCRIPTION OF THE DRAWINGS

These and other features, aspects, and advantages of the disclosure hereof will become better understood when the following detailed description is read with reference to the accompanying figures, wherein.

DETAILED DESCRIPTION

Figure 1:
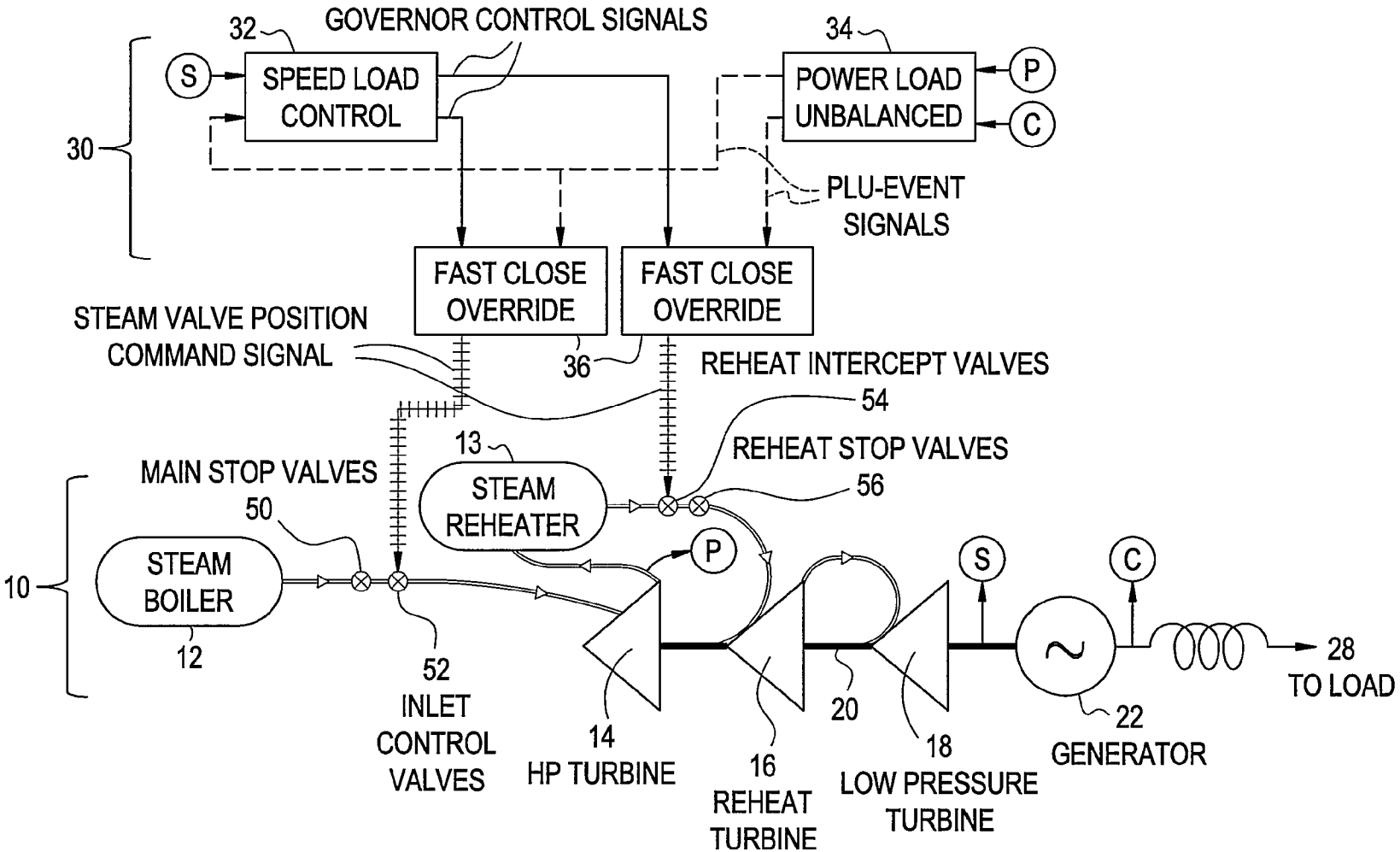
FIG. 1 depicts a typical reheat turbine-generator and associated control system.

FIG. 1 illustrates a typical turbine-generator 10 that is controlled by a turbine control system 30. The typical turbine-generator 10 illustrated is a tandem-compound reheat design and is connected to a steam boiler 12 with a steam reheater 26. The tandem-compound turbine-generator consists of a high-pressure turbine 14, a reheat turbine 16, a low-pressure turbine 18, a common shaft 20, an electric generator 22, and one or more valves. In the typical turbine-generator 10, steam from the steam boiler 12 passes through a high-pressure turbine 14, then through the steam re-heater 26 and on through the reheat turbine 16 and through the low-pressure turbine 18. The high-pressure turbine 14, the reheat turbine 16, and the low-pressure turbine 18 are mechanically connected to the common shaft 20. Steam flow through the multiple turbines stages causes the common shaft 20 to rotate, which in turn drives the electric generator 22 which generates electricity. The electric generator 22 supplies electric power to a load 28. Steam flow through the multiple turbine stages and thus electric power production is controlled by a main steam stop valve 50, an inlet control valve 52, a reheat intercept valve 54, and a reheat stop valve 56. The main steam stop valve 50, the inlet control valve 52, the reheat intercept valve 54, and the reheat stop valve 56 are controlled by the turbine control system 30.

The turbine control system 30 includes a turbine speed-load control module 32, a power-load unbalance module 34, and one or more fast close override modules 36. The turbine speed-load control module 32 controls the position of the main steam stop valve 50, the inlet control valve 52, the reheat intercept valve 54, and the reheat stop valve 56. The power-load unbalance module 34 detects a stage pressure of the turbine, illustrated in FIG. 1 as the steam leaving the high-pressure turbine 14, and the current generated by generator 22. Additionally, the power-load unbalance module 34 utilizes algorithms, described in further detail herein, to detect a loss of load event and to issue a power-load unbalance event signal to the fast close override devices 36 associated with the inlet control valve 52 and the reheat intercept valve 54. The fast close override devices 36 cause the inlet control valve 52 and the reheat intercept valve 54 to rapidly close and cut off steam to the steam turbine resulting in turbine power reduction. The reopening of the inlet control valve 52 and the reheat intercept valve 54 is coordinated by both the power-load unbalance module 34 and the speed-load control module 32 to prevent overdriving of the load and consequent emergency overspeed trip action. In an exemplary embodiment, the functions of the power-load unbalance module 34 and the turbine speed-load module 32 are combined into a single control module.

Figure 2A:
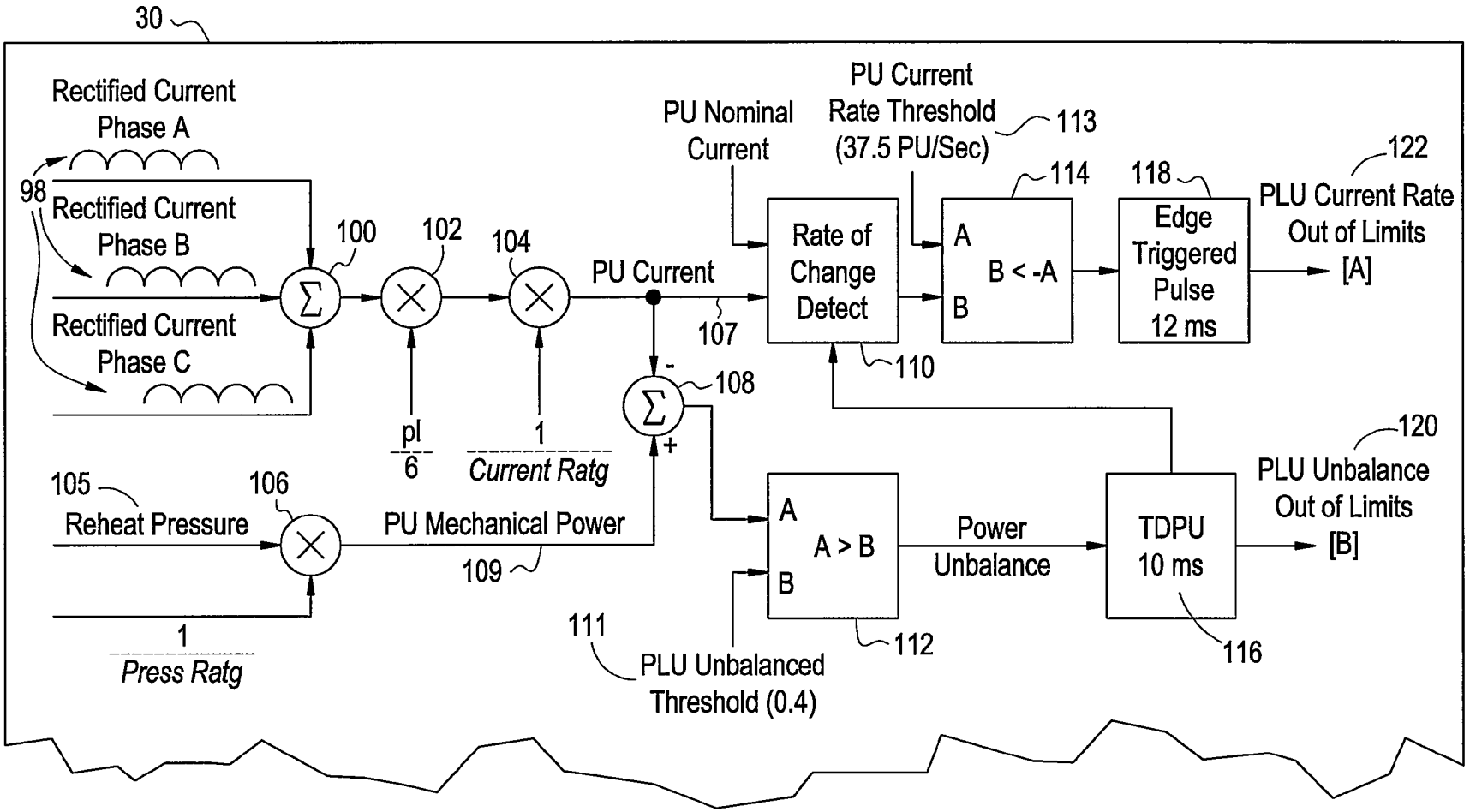
FIGS. 2A and 2B depicts a block diagram of an exemplary embodiment of a reheat turbine-generator control system.
Figure 2B:
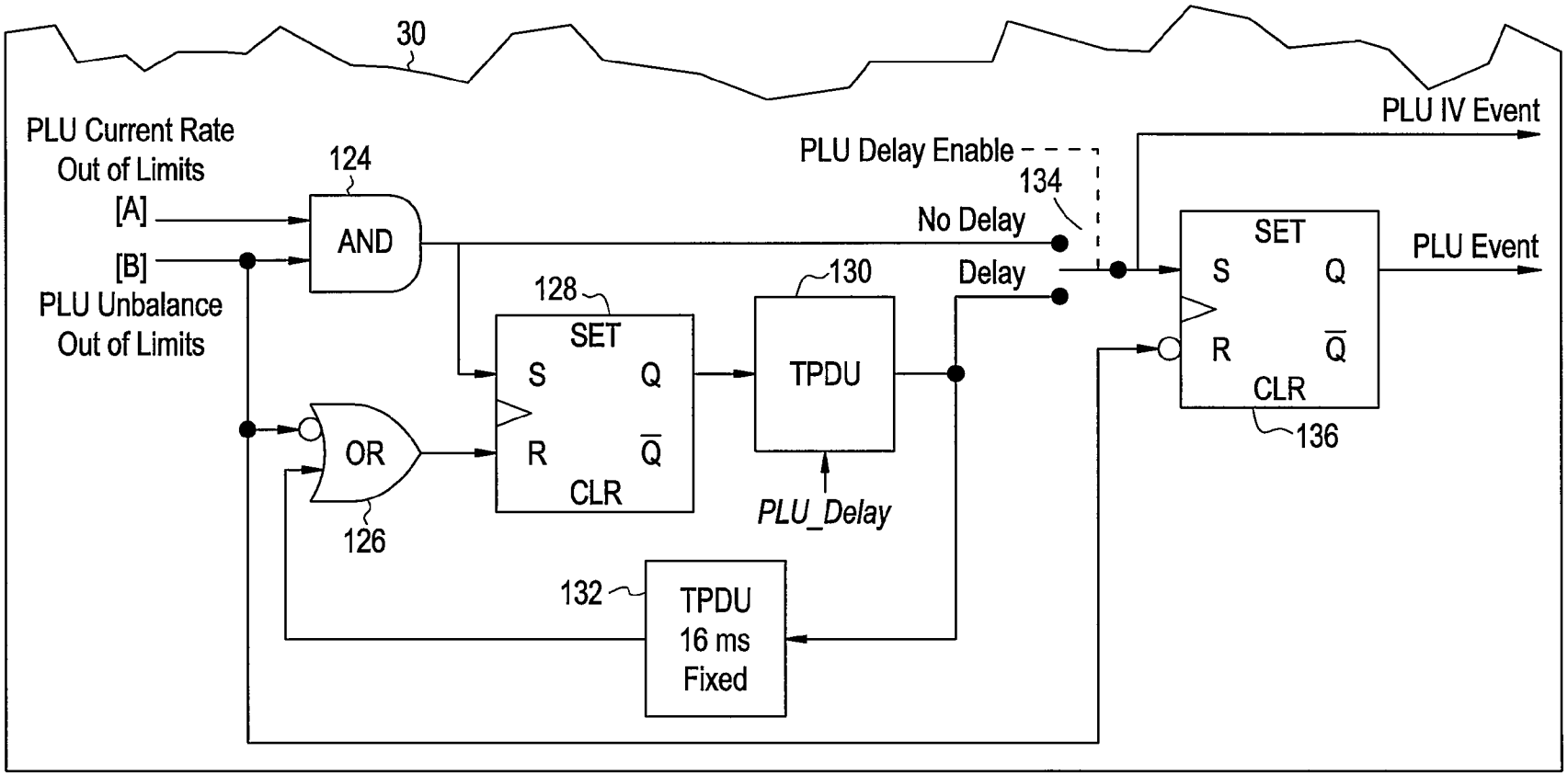

Turning now to FIG. 2, a block diagram of an exemplary embodiment of a turbine control system 30 is shown. The turbine control system 30 includes one or more sensing devices 98, such as current transformers, which are used to sense one or more generator phase currents. The generator phase currents are rectified and presented to a summing junction 100 that generates a total summed rectified current. The total rectified current is then processed by one or more multipliers 102 and 104 to yield a per unit current signal 107. A turbine stage pressure signal, here reheat pressure signal 105, which is a measurement of turbine mechanical power, is normalized by multiplier 106 to yield a per unit mechanical power signal 109. The per unit current signal 107 is subtracted from the per unit mechanical power signal 109 by a summing junction 108 and then compared to a threshold value 111 by a comparator 112. The comparator 112 generates a Boolean signal, true or false, which is presented to a time delay pick up 116.

The time delay pick up 116 is programmed to output a power-load unbalance out of limit signal 120 which is a logic signal of true when the input to the time delay pick up 116 is true and remains true for at least ten milliseconds. Otherwise, the power-load unbalance out of limits signal 120 remains at a logic level of false. The minimum sustained power unbalance duration is verified by the time delay pick up 116. The input to the time delay pick up 116 must be held true for ten milliseconds before the output of the time delay pick up 116 is set to true. If the input to the time delay pick up 116 becomes false before the end of ten milliseconds then the ten millisecond timer of the time delay pick up 116 is reset to zero and must again be held true for a minimum of ten milliseconds. At any time, if the input to the time delay pick up 116 goes to a logic level of false, the power-load unbalance out of limits signal 120 will go to a logic level of false. It will be appreciated that the duration of time required for the time delay pick up 116 can be set to any suitable time and that the time of ten milliseconds as used, based on the transient electrical load characteristics detected by sensing devices 98, herein is the amount of time used in an exemplary embodiment of the time delay pick up 116.

Figure 3:
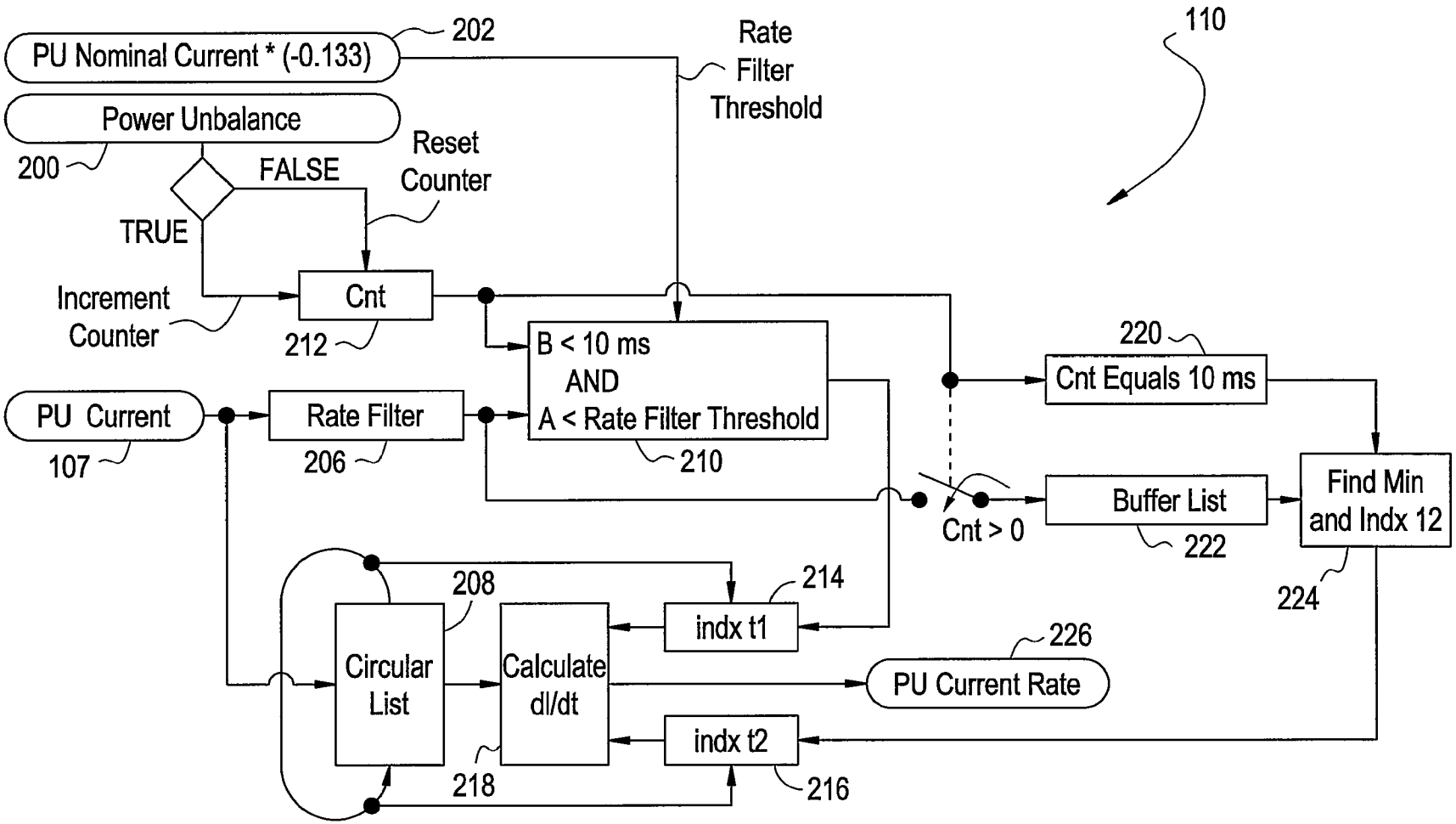
FIG. 3 depicts a block diagram of an exemplary embodiment of a change detect function.

Continuing with FIG. 2, a rate of change detect function 110 computes the measured current rate of change. The details of the rate of change detect function 110 are illustrated in FIG. 3. The output of the rate of change detect function 110 is compared to a per unit current rate threshold signal 113 with a comparator 114. In an exemplary embodiment, the per unit current rate threshold signal 113, based on the transient electrical load characteristics, is set to a value of −37.5 PU/sec. If the per unit current rate threshold signal 113 is exceeded by the output of the rate of change detect function 110 and the input to the time delay pick up 116 has been sustained for ten milliseconds or more, then an edge-triggered pulse 118 will be generated as a power-load unbalance current rate out of limit signal 122. The power-load unbalance current rate out of limit signal 122, which will last for a configured duration of time, is necessary for the reheat intercept valve 54 to function in the desired manner; that is to actuate and then close after the configured duration. In an exemplary embodiment, the configured duration of time is at least twelve milliseconds.

The turbine control system 30 also includes a AND gate 124, an OR gate 126, a master set-reset logic element 136, a secondary set-reset logic element 128, and one or more time delay pick up elements 130, 132. It is necessary for both the power-load unbalance current rate out of limit signal 122 and the power-load unbalance out of limit signal 120 to be simultaneously true in order to initiate and latch a power-load unbalance event, this condition is determined by the AND gate 124. When the power-load unbalance out of limit signal 120 becomes false it initiates a reset signal to the master set-reset latch element 136, which clears the power-load unbalance event. In an exemplary embodiment of the reheat turbine-generator control system 30, an optional programmable delay time may be added before a power-load unbalance event is initiated. The optional programmable delay time is controlled by the OR gate 126, the secondary set-reset latch element 128, and the time delay pick up elements 130, 132. The power-load unbalance event will use the optional programmable delay time only if power-load unbalance delay enabled signal 134 has a logical value of true.

Turning now to FIG. 3, a block diagram of an exemplary embodiment of the rate of change detect function 110 is shown. The rate of change detect function 110 has one or more inputs including: the per unit current 107; a power unbalance logic signal 200; and a nominal per unit current operating point of the turbine-generator system 202. The output of the rate of change detect function 110, a per unit current rate of change 226, is characterized by the following equation:

$$\frac{dI}{dt} = \frac{PerUnit\ Current(t_2) - PerUnit\ Current(t_1)}{t_2 - t_1}$$

In order to make the above calculation the per unit current 107 at time t1 and the per unit current 107 at time t2 must be determined. In an exemplary embodiment, the per unit current 107 is sampled at 500 Hz and stored in a circular list 208, which is used in calculating the per unit current rate of change 226.

Continuing with FIG. 3, a rate discriminator filter 206 is characterized by the following transfer function:

$$H(s) = \frac{S}{S+50}$$

The rate discriminator filter 206 has the desired characteristic for detecting an actionable current rate of change when used with rectified current inputs. When the output of the rate discriminator filter 206 drops below a set threshold, a large current drop is indicated. After detecting a large current drop, an initial time tag (t1) 214 is then stored and the sampled output of the discriminator rate filter 206 is stored in a buffer 222. The set threshold level of the discriminator rate filter 206 is based on the nominal per unit current operating point of the turbine-generator system 202.

Additionally, when the power unbalance logic signal 200 is a logical true the output of the discriminator rate filter 206, which is stored in the buffer 222, is scanned to find a minimum and the corresponding time tag (t2) 216. If a minimum is not achieved in the ten millisecond time frame then the current measured at ten milliseconds is used as the minimum and time tag (t2) 216 is thereby established. With the time tag (t1) 214 and time tag (t2) 216 established, the per unit current stored in the circular list 208 can be then accessed for the computation of the current rate of change 226. As depicted in FIG. 2, the output of the rate of change detect function 110, the per unit current rate of change 226, is sent to per unit current rate of change comparator block 114 for signal processing of the logic signal to generate a twelve millisecond pulse 118 indicating that a power-load unbalance current rate out of limit has been detected.

A power-load unbalance event is triggered when both the power-load unbalance current rate out of limit signal 122 and the power-load unbalance out of limit signal 120 are true. Once a power-load unbalance event is triggered the reheat turbine-generator control system 30 actuates at least one of the main steam stop valve 50, the inlet control valve 52, the reheat intercept valve 54, and the reheat stop valve 56. The fast close override devices 36 may be used to cause the inlet control valve 52 and the reheat intercept valve 54 to rapidly close and cut off steam to the steam turbine resulting in turbine power reduction. Additionally, the reopening of the inlet control valve 52 and the reheat intercept valve 54 is coordinated by both the power-load unbalance module 34 and the speed load control module 32.

Figure 4A:
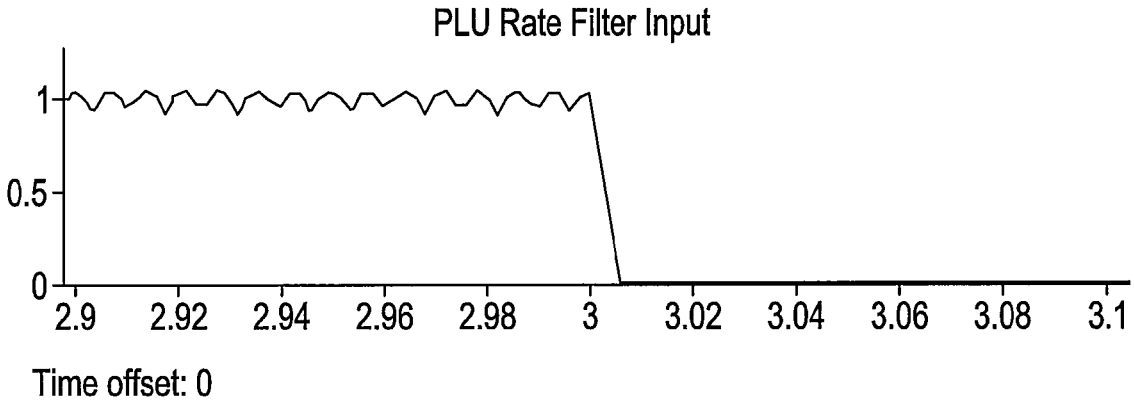
FIGS. 4A and 4B depicts a typical response of a generator rate filter.
Figure 4B:
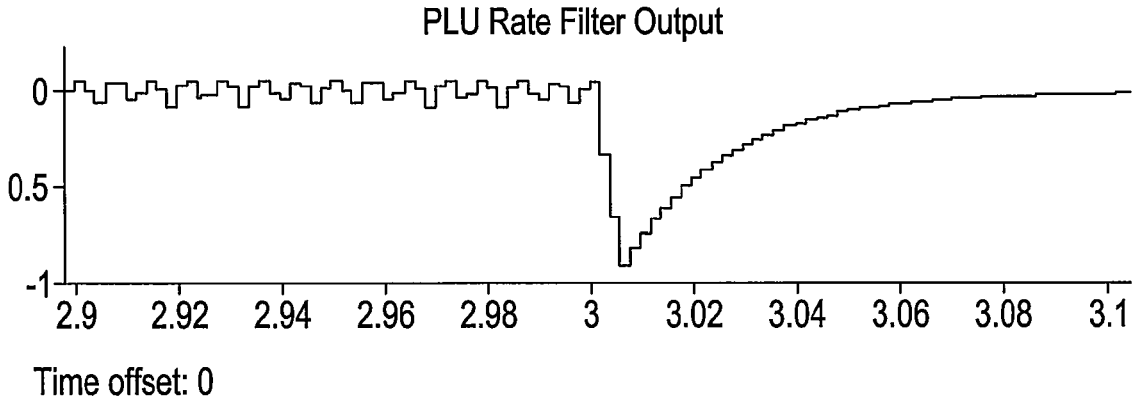

FIG. 4 illustrates a typical response of the discriminator rate filter 206 to a full load loss, in this example a 100% load loss is experienced in 0.006 seconds as established by 60-Hz line characteristics. The characteristics of the discriminator rate filter 206 show an output dynamically changing when there is a rapid change in input. Furthermore, the discriminator rate filter 206 output relaxes back to a "zero" output when the input is no longer changing. The output minimum of the discriminator rate filter then establishes the point in time at which the input stopped falling. This characteristic is very useful for establishing the time tag t2 216 and further to more accurately determine per unit current rate of change.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for controlling a turbine comprising:
- an improved detection of a power-load unbalance between a turbine and a generator;
- measuring a duration of said power-load unbalance;
- verifying said power load unbalance;
- measuring a rate of loss for an electrical load; and
- regulating steam flow through said turbine responsive to said rate of loss for an electrical load and said duration of said power-load unbalance.

2. The method of claim 1 wherein said regulating steam flow comprises at least one of:
- actuating a main steam stop valve;
- actuating a inlet control valve;
- actuating a reheat intercept valve; and
- actuating a reheat stop valve.

3. The method of claim 1 wherein said detecting said power-load unbalance between said turbine and said generator comprises:
- sensing one or more generator phase currents;
- calculating the difference of a per unit current signal and a per unit mechanical power signal; and
- sensing the time duration of the power-load unbalance event.

4. The method of claim 1 wherein said measuring a rate of loss for an electrical load is performed by a rate discrimination filter.

5. The method of claim 1 wherein said regulating steam flow prevents overspeed of said turbine.

6. A turbine-generator control system comprising:
- a power-load unbalance module;
- a turbine speed-load control module; and
- one or more close override devices wherein said power-load unbalance module detects and determines a duration of a power-load unbalance between a turbine and a generator and verifies said power-load unbalance.

7. The system of claim 6 wherein said turbine speed load control module adjusts a parameter of said turbine responsive to said power-load unbalance between said turbine and said generator.

8. The system of claim 7 wherein said parameter comprises at least one:
- a position of a main steam stop valve;
- a position of a inlet control valve;
- a position of a reheat intercept valve; and
- position of a reheat stop valve.

9. The system of claim 6 wherein said power-load unbalance module comprises:
- a current sensor operable to sense a generator phase current;
- a comparator that generates a Boolean signal indicative of said power-load unbalance between a turbine and a generator; and
- a time delay pick up for measuring a duration of said power-load unbalance.

10. The system of claim 9 further comprising a rate discrimination filter operable to detect a current drop.

11. A system for anticipating and limiting overspeed of a turbine comprising:

means for detecting a power-load unbalance;

means for determining the duration of said power-load unbalance;

means for verifying said power-load imbalance;

means for calculating a current rate of change; and means for regulating steam flow through said turbine responsive to at least one of said means for detecting a power-load unbalance, said means for determining the duration of said power-load unbalance, and said means for calculating a current rate of change.

12. The system of claim 11 wherein said means for detecting a power-load unbalance comprises at least one of:

means for sensing one or more generator phase currents;

means for calculating a per unit current signal; and means for calculating a per unit mechanical power signal.

13. The system of claim 12 wherein said means for calculating a per unit current signal comprise means for summing said generator phase currents and means for scaling said generator phase currents.

* * * * *